US008919018B2

(12) United States Patent
Udovic

(10) Patent No.: US 8,919,018 B2
(45) Date of Patent: Dec. 30, 2014

(54) METHOD AND APPARATUS FOR CARD IMAGE TRANSFORMATION AND CONTENT SECURING

(75) Inventor: David J. Udovic, Atlantic Highlands, NJ (US)

(73) Assignee: HJovic Design LLC, Atlantic Highlands, NJ (US)

( * ) Notice: Subject to any disclaimer, the term of this patent is extended or adjusted under 35 U.S.C. 154(b) by 0 days.

(21) Appl. No.: 13/385,043

(22) Filed: Jan. 30, 2012

(65) Prior Publication Data

US 2013/0167414 A1 Jul. 4, 2013

Related U.S. Application Data

(60) Provisional application No. 61/438,029, filed on Jan. 31, 2011.

(51) Int. Cl.

| | |
|---|---|
| ***G09F 1/00*** | (2006.01) |
| ***G09F 1/04*** | (2006.01) |
| *G09F 1/08* | (2006.01) |

(52) U.S. Cl.

CPC ..... *G09F 1/04* (2013.01); *G09F 2001/085* (2013.01)

USPC ..... 40/124.06; 40/491

(58) Field of Classification Search

USPC ..... 40/124.06, 124.08, 124.09, 124.19, 491

See application file for complete search history.

(56) References Cited

U.S. PATENT DOCUMENTS

| | | | | |
|---|---|---|---|---|
| 418,135 | A | | 12/1889 | Kaufmann |
| 639,679 | A | | 12/1899 | Kaufmann |
| 733,819 | A | | 7/1903 | Demmon |
| 850,150 | A | | 4/1907 | Glazier |
| 901,464 | A | | 5/1908 | Ormston |
| 944,385 | A | | 12/1909 | Spiegel |
| 946,407 | A | | 1/1910 | Spiegel |
| 956,916 | A | | 5/1910 | Wiederseim |
| 976,495 | A | * | 11/1910 | Reeves ..... 446/151 |
| 1,008,195 | A | | 11/1911 | Prichard |
| 1,112,147 | A | * | 9/1914 | Levie ..... 446/149 |
| 1,211,497 | A | | 1/1917 | Spiegel et al. |
| 1,259,297 | A | | 3/1918 | Winfield |
| 1,285,753 | A | | 11/1918 | Löwenstein |
| 1,603,592 | A | | 10/1926 | Glasner |
| 1,658,968 | A | | 2/1928 | Carroll |
| 1,699,383 | A | | 1/1929 | Taylor |
| 1,898,308 | A | | 2/1933 | Miller |
| 1,975,446 | A | * | 10/1934 | Cahn ..... 40/491 |
| 2,028,650 | A | | 1/1936 | Cunningham |
| 2,085,803 | A | | 7/1937 | Harrison |

(Continued)

*Primary Examiner* — Gary Hoge

(74) *Attorney, Agent, or Firm* — Brian K. Johnson, Esq., LLC

(57) ABSTRACT

A display system is disclosed having a casing, a drawer and a stopping mechanism. The drawer is inserted into the casing and a hidden section of the drawer is alternately hidden from view and then displayed when the system transitions between retracted and extended positions respectively. The drawer may optionally include an insert that is displayed when the display is in the extended position. In one aspect, the stopping mechanism may be a flexible membrane attached to the inside of the casing and the drawer back. Alternatively, the casing may include a crossbar section disposed within said drawer where fasteners within said drawer prevent drawer extension beyond the crossbar thereby providing the stopping mechanism. Functionally, the display system may serve as a greeting card where images on the casing and drawer are drawn apart on drawer extraction to reveal extended images on the hidden section and the insert.

20 Claims, 13 Drawing Sheets

(56) References Cited

U.S. PATENT DOCUMENTS

| | | | | | |
|---|---|---|---|---|---|
| 2,145,794 | A | * | 1/1939 | Huber | 446/150 |
| 2,259,205 | A | * | 10/1941 | Heilpern | 446/149 |
| 2,283,777 | A | | 5/1942 | Wending | |
| 2,367,967 | A | | 1/1945 | Schwartz | |
| 2,485,806 | A | | 10/1949 | Berg | |
| 2,554,098 | A | | 5/1951 | Eisner | |
| 2,611,201 | A | | 9/1952 | Bellis | |
| 2,680,328 | A | | 6/1954 | Youngren | |
| 2,844,898 | A | | 7/1958 | Youngren | |
| 2,884,724 | A | | 5/1959 | Lohnes | |
| 2,963,806 | A | | 12/1960 | King | |
| 2,988,845 | A | | 6/1961 | Lohnes | |
| 3,001,690 | A | | 9/1961 | Patterson | |
| 3,199,238 | A | | 8/1965 | Brown | |
| 3,225,474 | A | | 12/1965 | Dusseau | |
| 3,318,040 | A | | 5/1967 | Kinberg | |
| 3,486,270 | A | | 12/1969 | Maher | |
| 3,566,483 | A | | 3/1971 | Axelrod | |
| 3,848,348 | A | | 11/1974 | Hawley | |
| 3,946,508 | A | | 3/1976 | Booras | |
| 3,994,091 | A | * | 11/1976 | Modell | 446/149 |
| 4,054,242 | A | | 10/1977 | Strobe | |
| 4,697,364 | A | | 10/1987 | Dean | |
| 4,809,453 | A | | 3/1989 | Morgan | |
| 4,913,694 | A | | 4/1990 | Alphenaar et al. | |
| 5,004,271 | A | * | 4/1991 | Piatt | 283/65 |
| D322,808 | S | | 12/1991 | Piechocki | |
| 5,088,220 | A | | 2/1992 | Hibsch | |
| 5,110,155 | A | | 5/1992 | Piechocki et al. | |
| 5,112,290 | A | | 5/1992 | Hibsch | |
| 5,287,641 | A | * | 2/1994 | Showers | 40/488 |
| 5,383,292 | A | | 1/1995 | Whittredge | |
| 5,409,381 | A | | 4/1995 | Sundberg et al. | |
| 5,494,445 | A | | 2/1996 | Sekiguchi et al. | |
| D373,382 | S | | 9/1996 | Nielsen | |
| D374,035 | S | | 9/1996 | Nielsen | |
| 5,580,098 | A | * | 12/1996 | Gates | 281/38 |
| 5,670,219 | A | | 9/1997 | Na | |
| 5,761,836 | A | | 6/1998 | Dawson | |
| 5,778,578 | A | | 7/1998 | Drapcho et al. | |
| 5,901,484 | A | | 5/1999 | Seder | |
| 5,951,057 | A | | 9/1999 | Spector | |
| 5,971,157 | A | | 10/1999 | Howell | |
| 6,061,938 | A | * | 5/2000 | Young | 40/490 |
| 6,148,550 | A | | 11/2000 | Niedfeld | |
| 6,153,039 | A | | 11/2000 | Jacobsen | |
| 6,237,265 | B1 | | 5/2001 | Crowell | |
| 6,532,691 | B2 | * | 3/2003 | Carlin et al. | 40/491 |
| 6,543,162 | B1 | | 4/2003 | Niedfeld | |
| 6,732,459 | B1 | | 5/2004 | Clark | |
| 6,796,061 | B2 | | 9/2004 | Gemma, Jr. | |
| 6,877,263 | B2 | | 4/2005 | Clark | |
| 7,007,365 | B2 | | 3/2006 | Vanderburg | |
| 7,063,655 | B2 | | 6/2006 | Castello et al. | |
| 7,083,559 | B2 | | 8/2006 | Castello et al. | |
| 7,151,541 | B2 | | 12/2006 | Seder | |
| 7,222,446 | B2 | | 5/2007 | Foster | |
| 7,222,797 | B2 | | 5/2007 | Dávila et al. | |
| D544,040 | S | | 6/2007 | Burns | |
| 7,325,341 | B2 | | 2/2008 | Mouyal | |
| 7,363,738 | B2 | * | 4/2008 | Burtch | 40/491 |
| 7,415,786 | B2 | | 8/2008 | Boydston | |
| 7,503,482 | B2 | | 3/2009 | Wilen | |
| 7,552,553 | B2 | | 6/2009 | Kelly | |
| 7,603,802 | B2 | | 10/2009 | Oudekerk et al. | |
| 7,694,445 | B2 | | 4/2010 | Kelly | |
| 7,707,757 | B2 | | 5/2010 | Crowell | |
| 7,806,745 | B2 | | 10/2010 | Hohl | |
| 7,836,620 | B2 | | 11/2010 | Cole | |
| D629,458 | S | | 12/2010 | Clegg | |
| D629,459 | S | | 12/2010 | Clegg | |
| 7,861,441 | B1 | | 1/2011 | Hoellwarth | |
| 7,882,651 | B2 | | 2/2011 | Wilen | |
| 7,909,168 | B2 | | 3/2011 | Virvo | |
| 7,938,270 | B2 | | 5/2011 | Davis | |
| D641,779 | S | | 7/2011 | McClain et al. | |
| 7,975,411 | B2 | | 7/2011 | Kershner et al. | |
| D642,612 | S | | 8/2011 | McClain et al. | |
| D642,613 | S | | 8/2011 | McClain et al. | |
| D643,061 | S | | 8/2011 | McClain et al. | |
| 8,011,122 | B2 | | 9/2011 | Clegg | |
| 8,322,058 | B2 | * | 12/2012 | Mayer et al. | 40/491 |
| 2004/0082259 | A1 | | 4/2004 | Yum | |
| 2005/0183300 | A1 | | 8/2005 | Seder | |
| 2006/0209260 | A1 | | 9/2006 | Clegg | |
| 2009/0008921 | A1 | | 1/2009 | Mouyal | |
| 2010/0078340 | A1 | | 4/2010 | Mitchell | |
| 2011/0126437 | A1 | | 6/2011 | Bullington | |
| 2011/0146117 | A1 | | 6/2011 | Mayer et al. | |

* cited by examiner

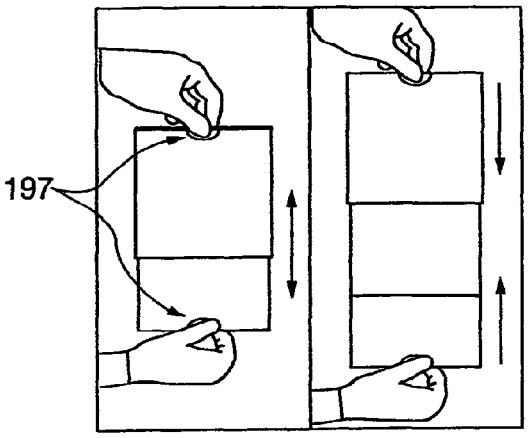
FIG. 2A
FIG. 2B
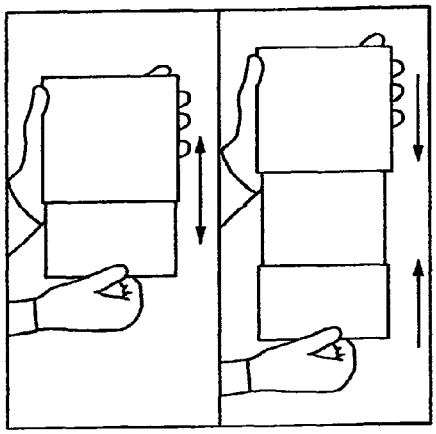
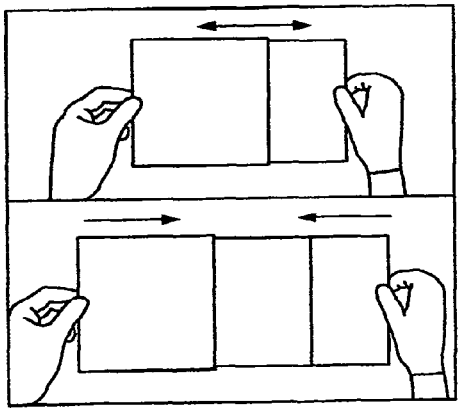
FIG. 2C

METHOD AND APPARATUS FOR CARD IMAGE TRANSFORMATION AND CONTENT SECURING

CROSS REFERENCE TO RELATED APPLICATIONS

This application claims priority to the U.S. Provisional Patent Application Ser. No. 61/438,029, titled "Card Device Facilitating Transforming Image and Secure Content" filed on Jan. 31, 2011 the contents of which are herein incorporated by reference in its entirety.

STATEMENT REGARDING FEDERALLY SPONSORED RESEARCH OR DEVELOPMENT

Not applicable.

BACKGROUND OF THE INVENTION

The disclosure relates generally to an insertion-based, casing and drawer display system that may function as a greeting card. In one particular aspect, an initially hidden insert may also be included to carry and present a supplemental card, separate from the body of the card.

Existing greeting cards generally serve their communication purposes by delivering a message, whether textual or graphical, in a non-continuous manner. In one time-honored design, the card consists of a cover and an interior and the card is opened along a common fold between them. The opening of this card provides two distinct visual planes that are experienced separately, i.e. they cannot be experienced within the same visual plane. In another historical design, the card consists of a multi-fold construction such that it opens in an accordion-like fashion. In this design, the opening of the card attempts to present the cover and interior in the same visual plane by revealing one or more interstitial images joining the cover and interior images. However, the visual experience of opening this card is not smooth since the eye is distracted by its unfolding in three-dimensional space.

Within the card industry, countless other variations in the construction and function of cards have been provided to accommodate card image transformations, including pop-up cars and window flaps. In addition, cards with sliding portions have been devised, such as that in U.S. Pat. No. 1,898,308 to Miller. In Miller's design a separate moveable card portion containing a first image is superimposed on the surface of the card having a second image and affixed thereto with a slot-and-tab arrangement. A pulling tab attached to the moveable card portion is pulled to simulate the movement of the first image against the second image as the moveable card portion slides across the card front as guided by the tab in the slot. In another design, provided in U.S. Pat. No. 1,699,383 to Taylor, a similar tab-and-slot arrangement is provided. In Taylor's design, a first image in a first card portion is replaced with a second image in a second card portion as guided by the tab-and-slot upon pulling a tab. In yet another design, provided in U.S. Pat. No. 7,707,757 to Crowell, a cascading image is accomplished with a series of card portions. Each of the series of card sections are connected, in a hook-and-ladder fashion, to the previous card section such that pulling the first card section results in the second section being pulled out and its image revealed, which in turn pulls out and reveals the third card section and image, etc. Again, as with previous designs, a tab-and-slot mechanism is used to guide the card extension.

None of these previous designs, however, present a card image transformation in which an integrated final image is continuously presented in a singular, visual perception plane so as to provide a visually smooth experience. Further, none of the heretofore known card designs possess an independently removable, separately secured content, hidden within the card and revealed upon the opening thereof.

BRIEF SUMMARY OF THE INVENTION

In one embodiment of the present invention, a display system is provided including a casing having a casing front and a casing back, the casing front and casing back affixed to one another and creating an envelope within the casing, the casing having an opening at one end for accessing the envelope; a drawer having a drawer front, a drawer back and a hidden section, the drawer back affixed to the drawer front and the hidden section such that the drawer front and the hidden section are displayed substantially coplanar as a front surface of the drawer, the hidden section of the drawer being capable of insertion into the casing through the opening such that the display system hides the hidden section when the hidden section is fully inserted into the casing; and a stopping mechanism attached to the casing and the drawer, the stopping mechanism preventing the drawer from being removed from the casing through the opening when the drawer is pulled to an extended display position, the hidden section being displayed between the casing front and the drawer front in the extended display position.

In particularly preferred embodiments of the above-described system the stopping mechanism is a foldable membrane, the membrane affixed at one end to an inner surface of the casing within the envelope and affixed at another end to the drawer, the foldable membrane being folded between the inner surface of the casing and the drawer back in the retracted position, the foldable membrane being extended to a fully extended position when the drawer back is in the extended position. In other embodiments, the casing includes a slit on the casing front so as to form a crossbar section across the opening at the slit, the hidden section inserted through the slit such that the crossbar section is disposed between the hidden section and the drawer back, the hidden section including fasteners near a fold dividing the drawer back and the hidden section, the fasteners being in contact with the crossbar section at the slit when the display is extended to a fully extended position such that the fasteners and the crossbar section create the stopping mechanism.

In yet other specific embodiments, the drawer front is affixed to the drawer back to create a pocket between the drawer front and the drawer back, the pocket having an opening formed at one edge of the drawer front for accessing the pocket; or an insert is disposed within the pocket; or the insert is one of: a card, a photograph, an electronic device, a message, a coupon, a toy, currency, a currency holder, a check, a tattoo or a sticker. In still other preferred embodiments, the drawer front and the casing front both contain images, the drawer front image and the casing front image appearing as two parts of a single image when the hidden section is fully inserted into the casing; or the hidden section has an image, the hidden image being hidden when the hidden section is fully inserted into the casing; or the image on the hidden section, the drawer front image and the casing front image appearing as three parts of a single image when the display system is in the extended display position; or the hidden section is an integrated part of the drawer back; the drawer front and the hidden section both have images, the images being printed on opposite sides of the drawer; and/or the foldable membrane is one of: a string, a piece of paper having at least 1 fold thereon, flexible plastic or a woven membrane.

In a very specific embodiment of the invention, a greeting card is provided including a casing having a casing front with an image and a casing back, the casing front and casing back affixed to one another with tabs on the sides of the casing and creating an envelope within the casing once the tabs are affixed, the casing having an opening at one end for accessing the envelope, the casing including a slit on the casing front so as to form a crossbar section across the opening at the slit; and a drawer having a drawer front, a drawer back having an image and a hidden section having an image, the drawer back affixed to the drawer front and the hidden section such that the drawer front and the hidden section are displayed substantially coplanar as a front surface of the drawer, the hidden section of the drawer being capable of insertion into the casing through the opening such that the casing hides the hidden section and image within the envelope and the card displays the casing front image and the drawer front image so as to appear as two parts of a single image when the hidden section is fully inserted into the casing, the hidden section inserted through the slit such that the crossbar section is disposed between the hidden section and the drawer back, the hidden section including fasteners near a fold dividing the drawer back and the hidden section, the fasteners being in contact with the crossbar section at the slit when the card is extended to a fully extended position so as to stop the card extension at the fully extended position, the hidden section image being revealed when the card is in an extended display position, and the image on the hidden section, the drawer front image and the casing front image appearing as three parts of a single image when the card is in the fully extended display position. In another particularly preferred embodiment of the method of assembling the present invention, a display system is constructed by inserting a drawer into a casing having an opening and a crossbar, the crossbar being formed by a slit in the casing; sealing a hidden section of the drawer near a fold at the top of the drawer with fasteners; lacing the hidden section of the drawer through the slit in the casing; and securing the hidden section to the drawer at a drawer bottom so as to encircle the crossbar and provide a stopping mechanism at the crossbar and the fasteners when the drawer is pulled out of the casing.

In specific embodiments of this method, the sealing of a drawer front of the drawer occurs near a fold at the bottom of the drawer on two sides so as to form a pocket behind the drawer front; or an insert is inserted into the pocket; or the step of securing includes tucking the hidden section behind the drawer front; and/or the step of securing includes adhering the hidden section to the drawer.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIGS. 2A, 2B and 2C are front views of the invention showing alternative orientations and methods of operating the invention in those orientations;

DETAILED DESCRIPTION OF THE INVENTION

To facilitate a clear understanding of the present invention, illustrative examples are provided herein which describe certain aspects of the invention. However, it is to be appreciated that these illustrations are not meant to limit the scope of the invention, and are provided herein to illustrate certain concepts associated with the invention. Specifically, the display device of the present invention is envisioned to be primarily applicable in the field of cards, which may include but is not considered to be limited to greeting cards, invitations, thank you cards, and note cards. These cards may be created for a variety of communication purposes and may include one or more of: professionally created artwork, text, logos, images, photographs etc. The communication purposes for the card may include but are not limited to birthdays, holidays, special occasions, notifications, and may include artwork and text as appropriate for each purpose, including the use of a variety of appropriate colors, designs and themes. The card may display graphics, text and images on all sides of the card depending upon the needs or requirements of the card design and the communication purpose. The card may be constructed of a variety of materials of various sizes, compositions, textures, and thicknesses. In one particularly preferred embodiment, the cards may be used to hold an insert that is separate from the body of the card such as a gift, currency, or a supplemental note. Finally, some of the terms below are used interchangeably. In particular the terms image, literal material, information, message and other references to material printed on the card are understood to be used interchangeably below and should be interpreted to be consistent with the specific content referenced in connection with the specific card being discussed. In this regard, the use of the term image does not preclude textual material, literal material, messages or other content. In a similar manner, the term image may be simply textual imagery or other, non-graphic, images.

Figure 1A:
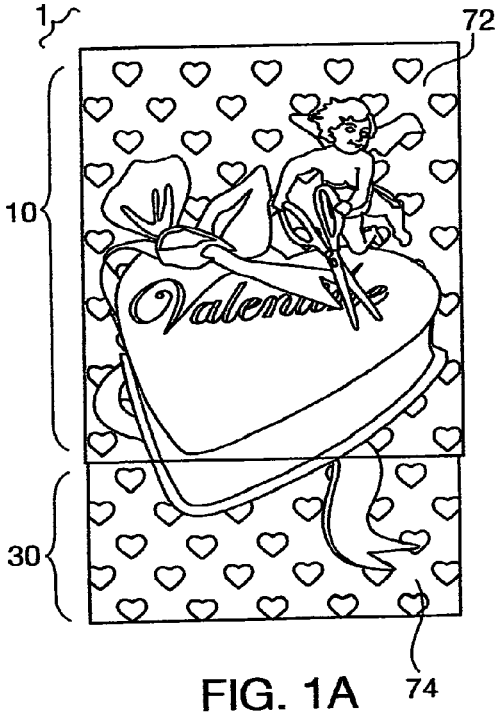
FIGS. 1A and 1B are front views of the invention in its retracted and extended positions respectively.
Figure 1B:
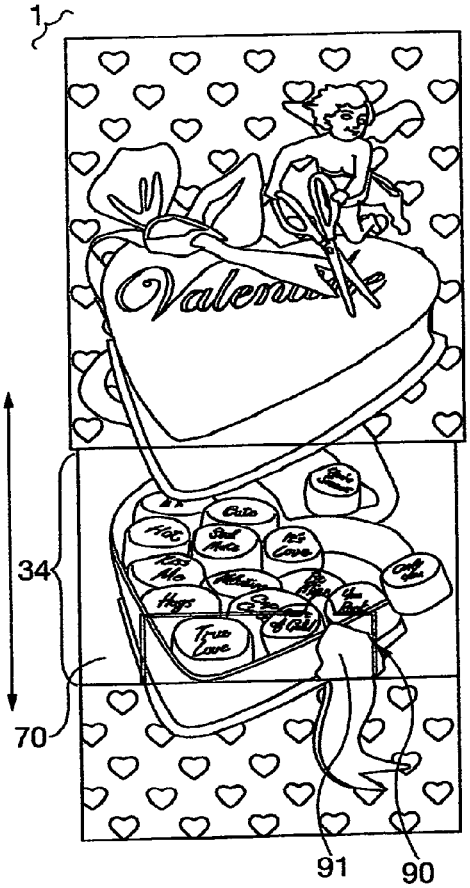

FIG. 1A shows the fully assembled card 1 in its retracted position. FIG. 1B shows the fully assembled card 1 in its extended position as pulled along the direction indicated by the arrow. Two primary components of the card include the casing 10 and the drawer 30 which may contain images 72 and 74 respectively. The drawer 30 resides within the casing and slides within the casing as the card transitions between the retracted and extended positions. When the casing and drawer are pulled in opposite directions, as shown in FIG. 1B, the viewable portion of the card smoothly extends in length to reveal an image 70 on hidden section 34. The linear extension of the card is halted by a stop/tracking mechanism as described below.

As shown in FIG. 1B, the revealed elements of the "inner content" of hidden section 34 may include image 70 having message content and/or sub-card 90. In one particularly preferred embodiment, the card facilitates a visual transformation by "growing" the original image provided on the casing and drawer within the same visual plane so as to provide the experience that the new image is increased in size. In the example of FIG. 1B, a closed candy box composed of image portions 72 and 74 is opened to reveal hidden image 70 showing the opened box of valentine hearts. In this fashion, the image is transformed in a single viewing plane and along a single axis and the transformation imparts the visual sensation of motion. Desirably, the visual experience of the extended image is enhanced if the perceived visual registration of the hidden image 70 and card cover images 72 and 74 provided on the casing 10 and drawer 30 respectively are properly aligned. FIG. 1B shows one example of a two position perception of motion (i.e. "open-closed") that may be imparted with the card extension process, although others are envisioned through a proper selection of images on the card. For example, a portrait-oriented card with an image of a train engine on the casing and smoke on the drawer may be extended to reveal additional train cars against a pastoral background on the hidden image portion such that the train appears to "move" as the card is extended. Likewise, a card cover containing an image of an ice skater on the casing with an image of a frozen pond on the drawer may be extended to reveal a larger view of the frozen pond containing ice skating tracks within the hidden image such that the path taken by the ice skater across the pond is displayed and the skater appears to be in motion during the card extension process.

In a like manner, an additional card portion, insert 90, may be provided as shown by the shadowed outline in FIG. 1B. Insert 90 may be a separate detachable card that is held by a pocket within drawer 30. As with the hidden image, the image on the insert 91 may be visually aligned such that the insert image blends in a visually seamless manner with the image 70 on the background hidden section. Upon removal of the insert, a second hidden image, behind the insert (not shown in FIG. 1B), may also be provided. In one embodiment, the image on this second hidden section may simply be a replication of the insert image such that the image 70 on the hidden section remains constant. Alternatively, the second hidden section may contain a second hidden image that is visually perceptible according to any of the methods described herein. The purposes of insert 90 may include, but is not limited to, providing a message, gift card, note, letter, advertisement, photograph, or electronic medium/device.

FIGS. 2A, 2B and 2C show three possible orientations and associated methods of extending the card. FIG. 2A shows the extension of the card in the vertical direction from its retracted state to its extended state by holding and pulling tab points 197, one each on the case and drawer cover. FIG. 2B shows an alternate way of holding and extending the card in the vertical direction from its retracted state to its extended state by grasping the sides of the casing with one hand while pulling the drawer down vertically with the other hand. FIG. 2C shows yet another orientation and manner of extending the card, in a horizontal direction, from its retracted state to its extended state. Depending upon the orientation of the card, it is conceivably opened in any direction, including angular or non-rectilinear directions, so as to support graphic and literal information on all cards sides, including possibly the card backside. Because of the nature of the visual change occurring between retracted and extended states, any conceivable image transformation, transformation of words, or presentation of surprise content may be provided.

A stopping and/or tracking mechanism is provided to connect case 10 and drawer 30 and ensure their proper operational movement with respect to each other. The description herein provides two such methods of construction. In first embodiment, a third component, distinct from the casing and drawer, provides the stopping and/or tracking mechanism. In the second embodiment, the stopping and/or tracking mechanism is integrated as part of the casing and/or drawer. Each embodiment has its advantages and disadvantages, and the selection of an optimal design depends on the card design requirements. The first embodiment, for example, will support irregular casing and drawer shapes. With a typical rectangular card shape, the second embodiment facilitates cost-effective assembly and operation. In the description below, and not by way of limitation, construction and the operational methods are provided only with respect to a rectangular card so as to facilitate comparisons and understanding between the two embodiments.

Figure 3A:
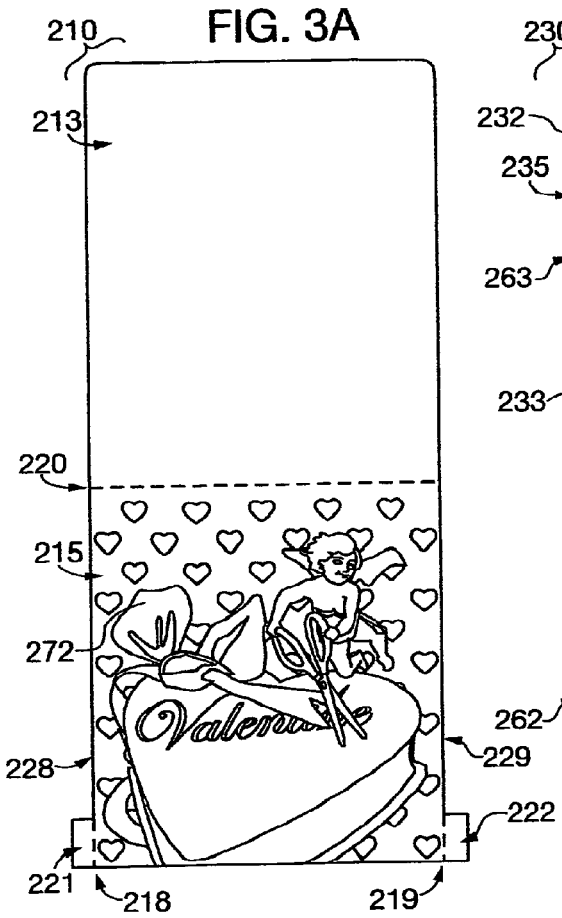
FIG. 3A is a front view of a casing according to one embodiment of the invention.
Figure 3B:
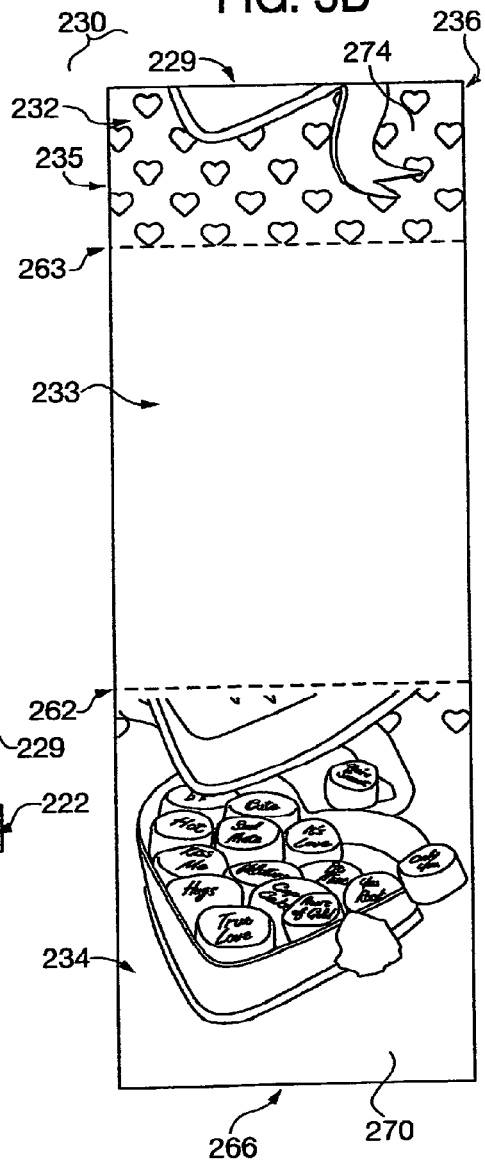
FIG. 3B is a front view of a drawer according to one embodiment of the invention.
Figure 3C:
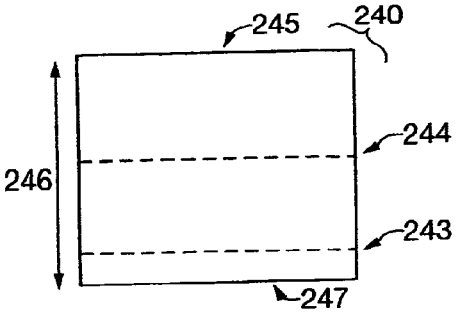
FIG. 3C is a front view of a stopping mechanism according to one embodiment of the invention.

As shown in FIGS. 3A, 3B and 3C the card components of the present invention are provided in more detail and the construction of the stopping mechanism as a separate component is described. FIG. 3A shows a casing 210 as the first of three components in the card. The casing is cut from a semi-rigid sheet, such as but not limited to card stock, and folds to form a chamber that holds the drawer component 230. The casing has four sections. The first two, casing back 213 and casing front 215, optionally containing image 272, are divided by casing fold 220. Casing tabs 221 and 222, as defined by casing folds 218 and 219 respectively, are provided on casing sides 228 and 229 respectively.

Figure 4:
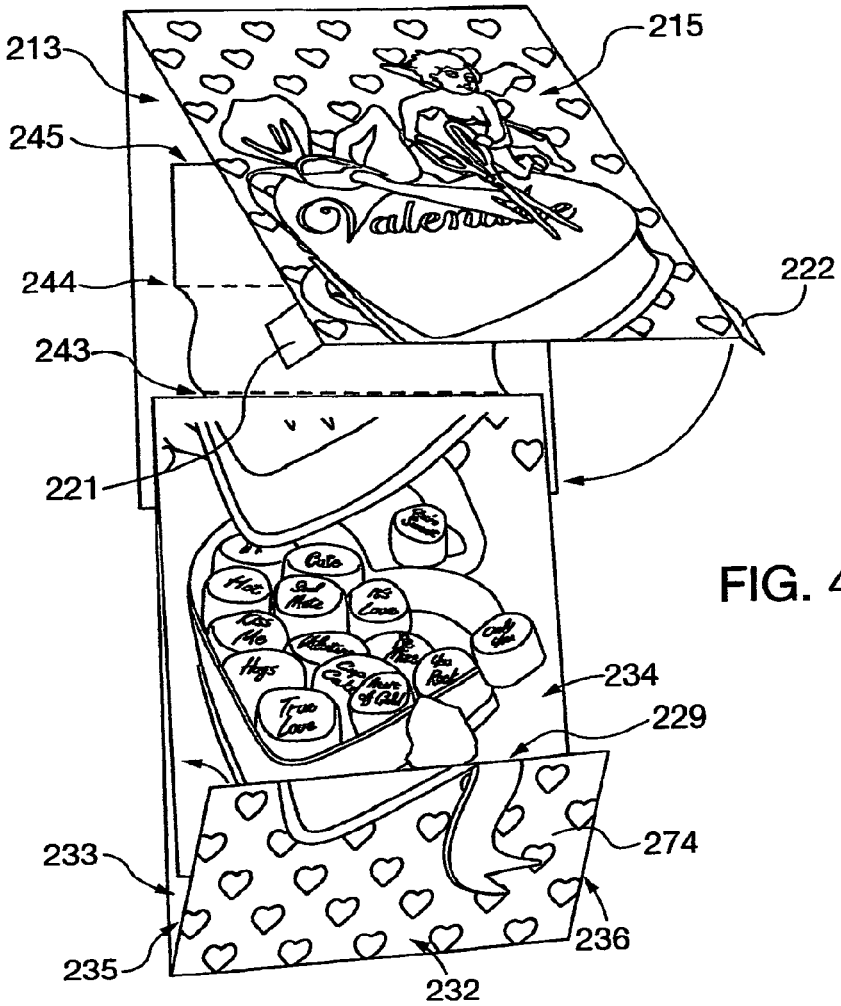
FIG. 4 is a three-dimensional perspective view of the assembly of the components of FIGS. 3A, 3B and 3C according to one embodiment of the invention.

FIG. 3B shows the second card component, drawer 230, which is also cut from a semi-rigid sheet, such as but not limited to card stock. Drawer 230 has three sections, drawer front 232, drawer back 233, and hidden section 234. Drawer front, containing optional image 274, is divided from drawer back 233 by pocket fold 263. Hidden section 234, containing image 270 is divided from drawer back 233 by drawer fold 262. If desired for more rigidity, hidden section 234 may be a separate card piece that is adhered to drawer back 233. Likewise, drawer front 232 may be a separate card piece that is adhered to the bottom of hidden portion 234. In either case of the separate/integrated drawer front piece, a pocket may be created having a bottom at fold 263 and existing between hidden section 234 and the back side of drawer front 232. As shown in FIG. 4 with respect to the integrated drawer front, the pocket has adhered sides 235 and 236 and unsealed side or edge 229. In alternative embodiments in which no pocket is needed, either of image 274 of drawer front or image 270 of hidden section 234 may be printed on the appropriate portion of the back side of drawer back 233, e.g. as part of a two-sided, stock printing process. In this design, images 274 and 270 would then line up when drawer 230 is folded at drawer edge 262 so as to provide the two respective image portions of the card on the front-facing surface of the card.

Two points of understanding should be made clear with respect to both card embodiments described herein. First, all references to the front side or surface and back side or surface of portions of the card embodiment provided in the FIGS. are with reference to that figure; i.e. the front side or surface is the surface facing out of the page and visibly shown, for example in FIGS. 3A-3C and FIGS. 10A and 11A, while the back side or surface is the surface facing into of the page and which is not visible in the FIGS. Second and fundamental to the invention, the hidden section 234 and any images printed thereon, refer specifically to the physical card section and associated image that is not displayed to a viewer when the card is in a fully retracted position. In this regard, and not depicted in the FIGS., the physical card section 234 labeled the hidden section may also include an exposed section below bottom edge 266 that remains revealed to a viewer when the card is in the fully retracted position. It should be clear that all references to the hidden section and any image(s) thereon refer to the card sections and images, or portions thereof, that are hidden from external view when the card is in the fully retracted position. The same applies to hidden section 334 described in detail below.

To assemble the card, drawer 230 slides within folded casing 210 and is attached to the casing by the third component, stopping mechanism 240 shown in FIG. 3C. The stopping mechanism shown there is a thin, flexible, and foldable membrane having folds 243 and 244, edges 245 and 247, and having a length 246. FIG. 4 shows a three-dimensional perspective view of how these three components fold and connect. As shown there, the stopping mechanism, as folded at 243 and 244, is connected to the backside of the casing back 213, i.e. the inside of the card after folding as shown. Connection of the back side of stopping mechanism 240 is made to the back side of the casing back 213 at the surface between edges 244 and 245 of stopping mechanism. The other connection to stopping mechanism 240 is made between the front side part of the stopping mechanism 240 at the surface between edges 243 and 247 of stopping mechanism. This second connection is then made to the front side of drawer 230 between pocket fold 263 and drawer fold 262. In this fashion the three components are joined by the flexible folded material comprising the stopping mechanism. In this arrangement, the front surfaces of the stopping mechanism 240, i.e. the surface between edge 245 and fold 244 and the surface between folds 243 and 244 meet when the drawer is inserted into the casing 230 and the card is in the retracted position. Final closure of casing 210 is accomplished when tabs 221 and 222 are folded and secured as described with respect to FIG. 5 below.

With regard to the operation of this embodiment of the invention, drawer 230 is in the extended position by pulling apart casing 210 and drawer 230 and is in the retracted position by pushing them together. In this manner, the stopping mechanism holds and guides the drawer as the card transitions between the extended and retracted positions.

Figures 5A, 5B, 5C:
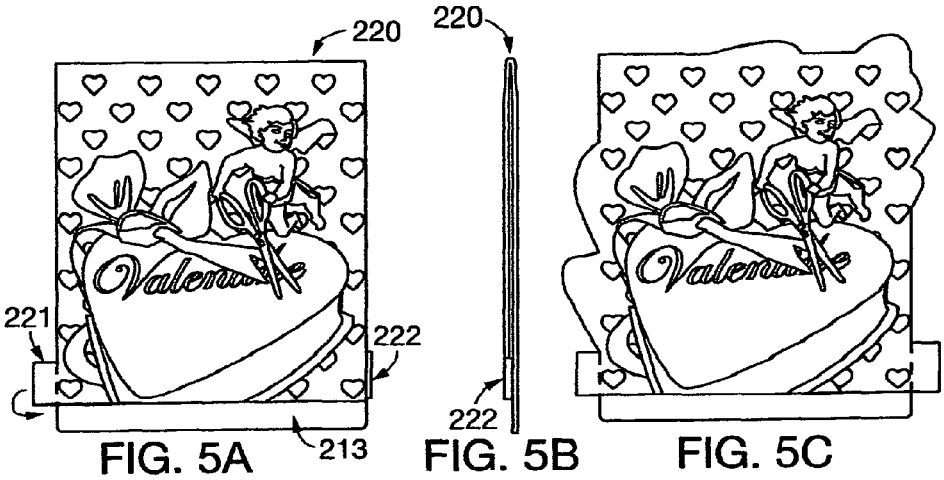
FIGS. 5A, and 5B are front and side views respectively of the casing according to one embodiment of the invention.
FIG. 5C is a front view of an alternative casing of FIG. 5A having a non-rectangular front surface according to one embodiment of the invention.

FIG. 5A shows a front view of the casing folded at casing fold 220 and highlighting casing's tabs 221 and 222 which act as guides for the drawer 230. During assembly, unfolded casing tab 221 is folded so as to have its front surface adhered to the back side surface of casing back 213. This creates an envelope within casing 210 for housing drawer 230. As shown in the side view of casing 230 in FIG. 5B, the location of the folded, adhered tab 222 is provided as adhering to the backside of casing back 213. In alternative embodiments, casing tabs 221 and 222 are not necessarily integral to and formed from the stock that forms casing 210 but rather may be added as an additional component of the card design. In still other embodiments, whether integral to the casing stock or not, the tabs may be greater in length and sealing ability. For example, the tabs/adherence devices may extend along the entire length of the folded casing sides so as to fully seal the casing and form the envelope therein. Further, the tab may be configured to adhere to the front side of the casing back 213 or may be entirely replaced by tape. Further, casing fold 220 need not be straight as indicated in FIG. 5C. This embodiment of the invention is envisioned as being able to support an irregular-shaped casing 210, including both front side and back sides thereof.

Figures 6A, 6B, 6C:
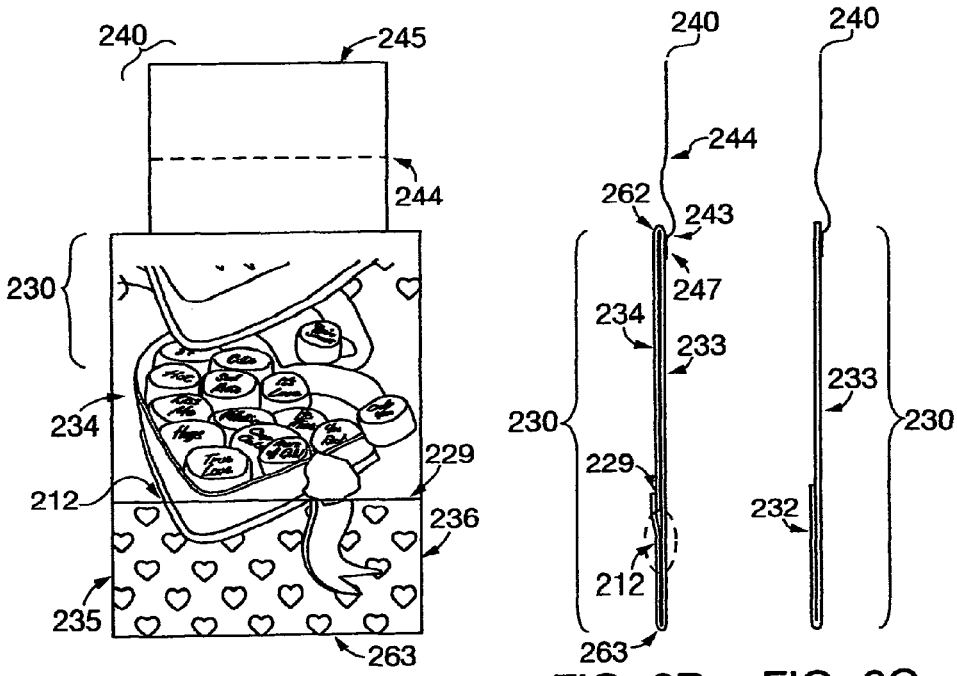
FIGS. 6A, 6B and 6C are a front view and two side views respectively of the drawer with the attached stopping mechanism according to various embodiments of the invention.

FIGS. 6A, 6B and 6C show several aspects of the stopping mechanism 240 and drawer 230 with pocket 212. The pocket is integral to the drawer and circumscribed by drawer fold 263 on the bottom side and adhered to drawer back 233 and hidden section 234 along sides 235 and 236. A pocket is provided at the opening between drawer front 232 and drawer back 233 at side 229 as shown. The pocket depth may run from side 229 to fold 263. The pocket size and shape can vary depending on the design requirements. Alternative to integral formation within the drawer stock itself, the pocket may be created via a separate card piece that is adhered to the drawer 230 on three sides.

The stopping mechanism itself is adhered to the drawer at or near edge 247 and the surface that extends between front side of the area between edge 247 and fold 243 as shown in FIG. 6B. The stopping mechanism is preferably adhered to the casing 210 in subsequent steps of the construction at or near edge 245 and specifically between back side of the surface between edge 245 and fold 244. Folds 243 and 244 are shown in the preferred folding arrangement in the stopping mechanism provided in FIGS. 6B and 6C. Essentially, these folds enable a rolling operation (upon extension/retraction) and flat seating positioning (in the fully retracted position) of the stopping mechanism inside the casing. The positioning of the folds can vary depending on the design requirement or the type of material composing the stopping mechanism. Further, the stopping mechanism can be implemented in any of a variety of manners using a variety of materials that afford flexibility, some of which may or may not require folds to perform the above-indicated function. Some examples of flexible materials that do not require folding are a string, a flexible plastic and/or a woven membrane. FIG. 6B shows the side view of the drawer 230 in its assembled state with folds 262 and 263 and displaying its three sections, 232, 233 and 234. Edge 229 is the opening of pocket 212. The particular embodiment shown in FIG. 6B provides for the above-described three-section drawer-pocket construction where the drawer is printed on one side of the stock. Pocket 212 is available from edge 229 down to the point at which drawer front 232 is sealed to drawer back 233 and may extend all the way down to fold 263 as desired. The stop/tracking mechanism, including folds 243 and 244, is connected at or near edge 247 and at the front side surface between 247 and 243 to the front side of drawer back 233. In an alternative drawer embodiment provided in FIG. 6C, a two-sided drawer printing application is provided that eliminates at least one fold. There, hidden image 270 is printed on the back side of drawer back 233 and drawer front 232 is folded at 263.

Figure 7A:
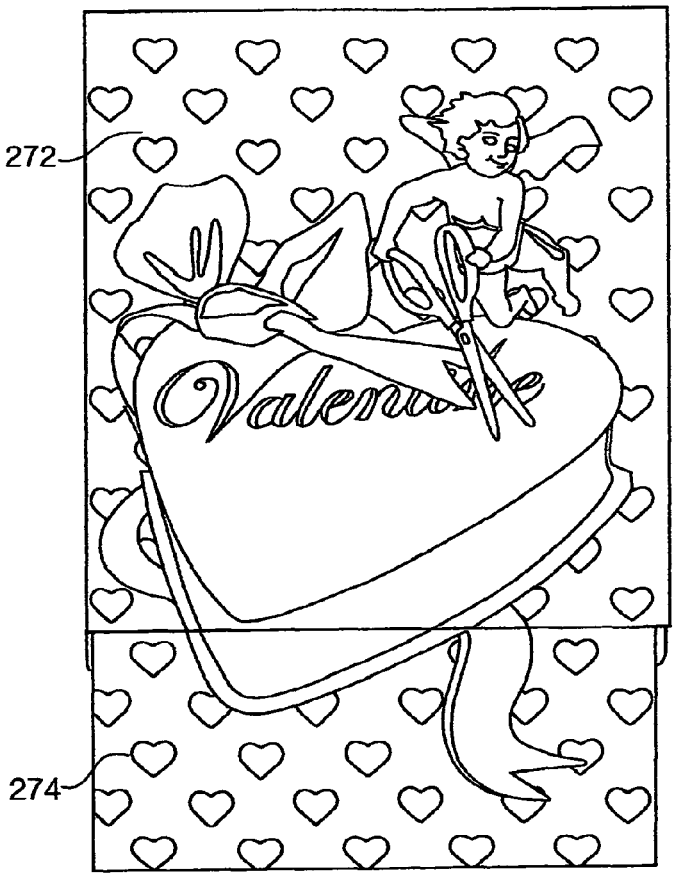
FIGS. 7A and 7B are front and side views respectively of the assembled card in the retracted position according to one embodiment of the invention.
Figure 7B:
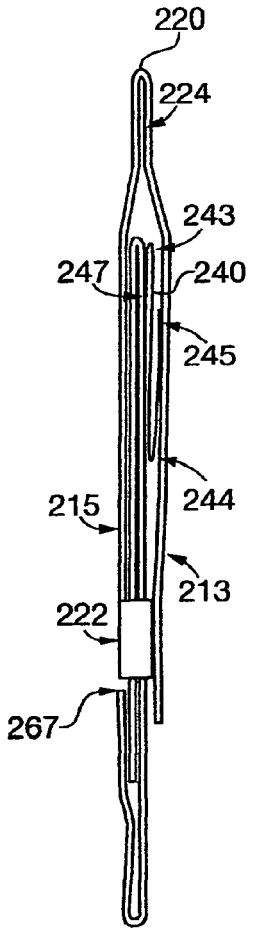

Front view of fully assembled card 1 is shown in its retracted position in FIG. 7A. Its corresponding side view is provided in FIG. 7B clearly showing the stopping mechanism. Images 272 and 274 on the casing front and the drawer front respectively are shown in FIG. 7A as being visually mated such so as to provide the perception of a seamless singular image composed of images 272 and 274. FIG. 7B illustrates how the stopping mechanism 240 folds up inside the casing with folds 243 and 244 as resting points to facilitate a flat seating. Given the materials chosen for the stopping mechanism, these folds may or may not be necessary. In most practical applications, however, folded creases assist in proper image orientation and movement tracking during the processes of retraction and extension. This is particularly true with less flexible materials. In this regard, some materials may express a memory of their fold as a crease while others will not. FIG. 7B also illustrates how casing sections 213 and 215 may be adhered at points down from case fold 220 at region 224. This feature assists in stopping the drawer in the retracted position by preventing the drawer from going too far up inside the casing. This is important for proper, full image mating and visual registration on the two images 272 and 274 in the retracted position. The point of attachment of the stopping mechanism to the casing at or near edge 245, the point of attachment of the stopping mechanism to the drawer at or near edge 247, and tab 222 are also shown in one preferred embodiment of the invention.

In a retracted position, shown in FIGS. 7A and 7B, the stopping force may be any one of several mechanisms, including but not limited to, the length of adherence of region 224 down from case fold 220, the edge of drawer front 267 which meets the casing at some point, and/or the natural seating position of stopping mechanism 240, particularly where the stopping mechanism is rigid and has a memory of its folded position, for example.

Figure 8A:
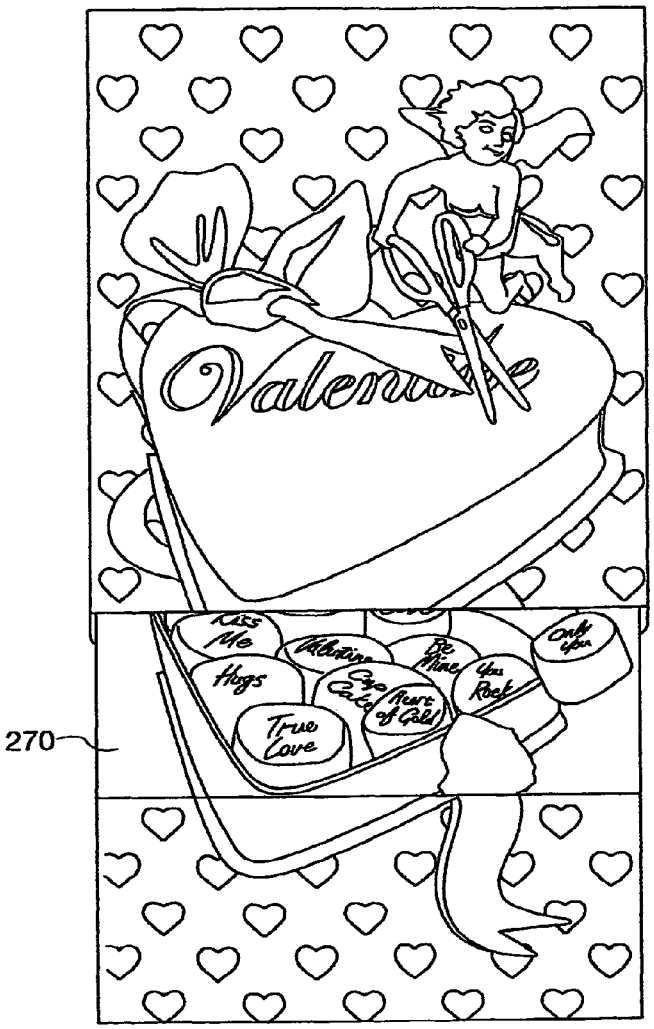
FIGS. 8A and 8B are front and side views respectively of the assembled card in a partially extended position according to one embodiment of the invention.
Figure 8B:
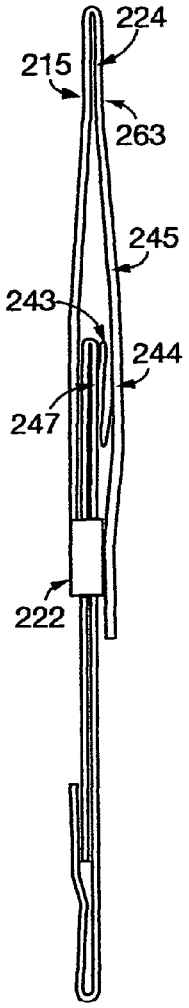

Front view of fully assembled card 1 is shown in a partially extended position in FIG. 8A. Image 270 on hidden section 234 is partially revealed in this card position. FIG. 8B shows the side view of the card in the partially extended position and demonstrates the rolling of stopping mechanism 240 against itself between the two folds 243 and 244 as the card is extended. Tabs 221 and 222 hold the casing together and guide the drawer during its extension. The point of attachment of stopping mechanism 240 to the casing is at or near edge 245. The point of attachment of the stopping mechanism to the drawer is at or near edge 247. The casing envelope created between case back 213 and case front 215 can expand to assist the rolling of stopping mechanism 240 during drawer extension and retraction. The envelope volume is also affected by the length of the adherence region 224 down from case fold 220 and the length and securing points of tabs 221 and 222.

Figure 9A:
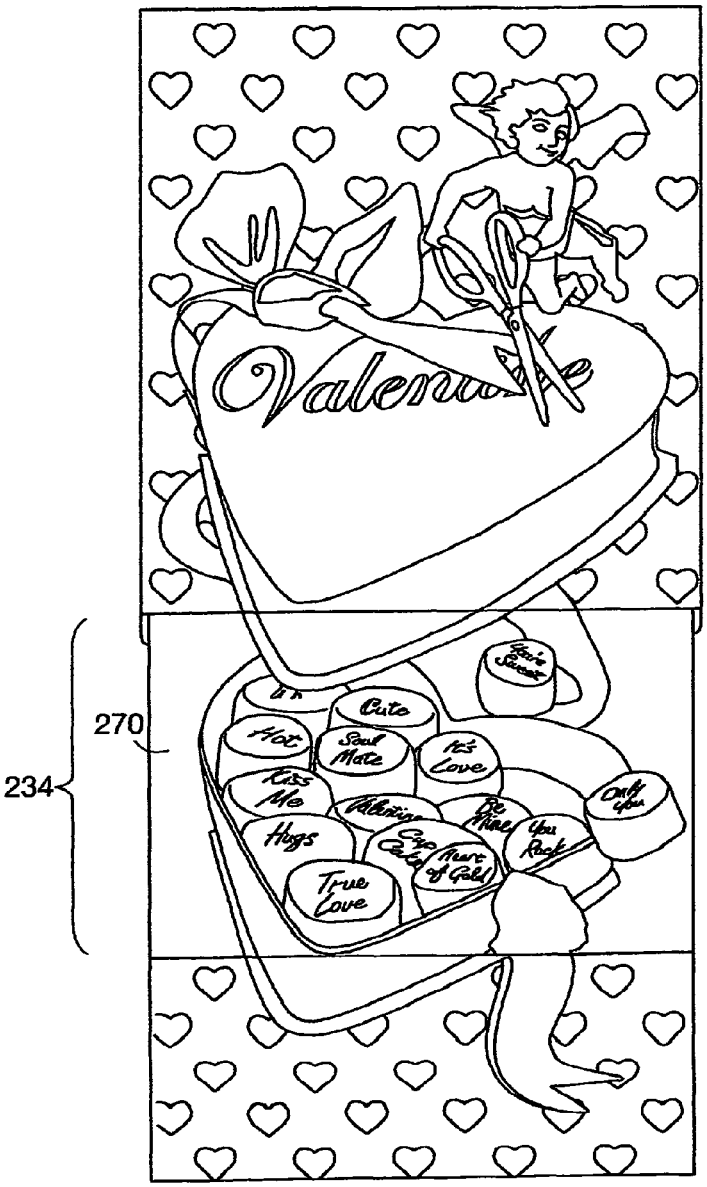
FIGS. 9A and 9B are front and side views respectively of the assembled card in a fully extended position according to one embodiment of the invention.
Figure 9B:
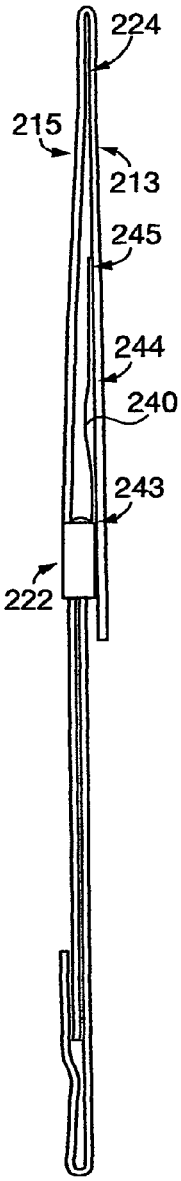

Front view of fully assembled card 1 is shown in a fully extended position in FIG. 9A. Image 270 on hidden section 234 is fully revealed in this card position and provides a mating image between images 272 and 274. FIG. 9B is a side view of the card in the fully extended position and demonstrates the fully extended stopping mechanism 240 with the substantial elimination of one or both of folds 243 and 244. The casing envelope created between case back 213 and case front 215 is flattened a bit from the partially opened position of FIG. 8. Three features are important for proper, full image mating and visual registration on the three images 270, 272 and 274 in the fully extended position: 1) the point of attachment of stopping mechanism 240 to the casing at or near edge 245, 2) the point of attachment of the stopping mechanism to the drawer at or near edge 247, and 3) the length 246 of stopping mechanism 240.

By exposing hidden image 270, the card recipient experiences the full impact of the present invention. The extension of the card also exposes any inner contents within the card in certain embodiment in which a pocket is provided so as to provide additional visual impact on the recipient.

In a second embodiment of the invention, the above-described perceptual advantages are provided without a third component to create the stopping mechanism. In this embodiment, the stopping mechanism is integrated within the casing, and therefore, the card requires only two components, casing and drawer, thereby making card construction easier, cheaper and slightly more accurate in the image presentation.

Figure 10A:
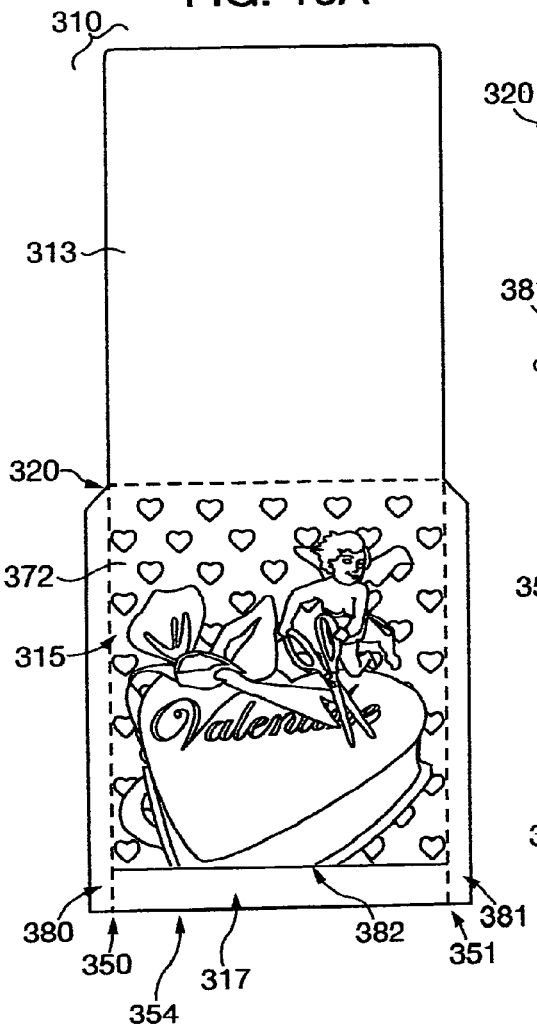
FIGS. 10A, 10B and 10C are a flat sheet front view, a perspective view and a fully assembled front views respectively of a casing according to a second embodiment of the invention.
Figure 10B:
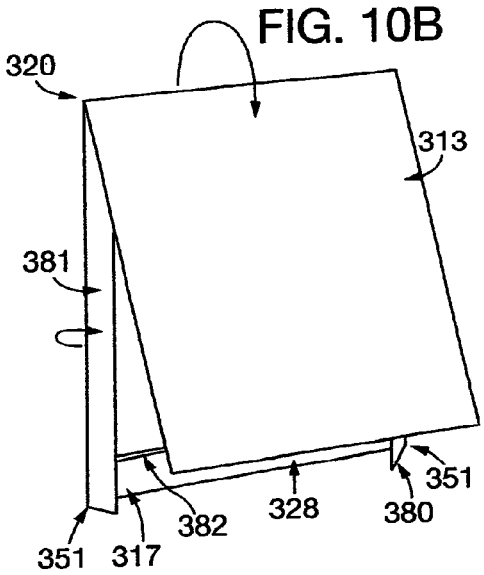
Figure 10C:
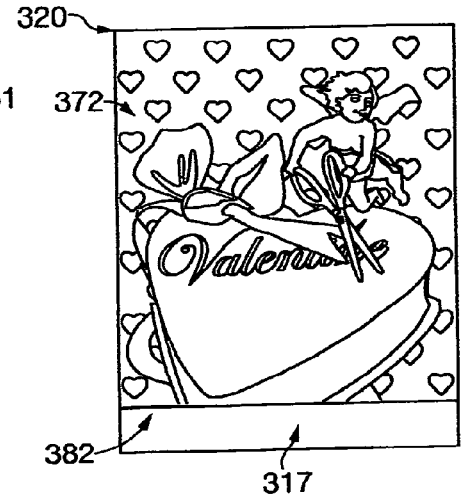

FIGS. 10A, 10B and 10C show casing 310 for this embodiment. Here, casing 310 has four sections: casing back 313, casing front 315, first tab 380, and second tab 381. First and second tabs 380 and 381 are defined by first and second folds 350 and 351 respectively. Casing back 313 and casing front 315 are delimited by casing fold 320. Crossbar section 317 is attached to first and second tabs 380 and 381 at the card sides and is separated from casing front 315 by slit 382. Image 372 is provided on casing 310 as a cover image for the card.

FIG. 10B shows a three-dimensional rear perspective view of the casing after it has been folded at folds 320, 350, and 351. This view shows that first and second tabs 380 and 381 have been folded towards the back side of casing front 315 in preparation for adherence to the back side surface of casing back 313 so as form an envelope within the casing. Adhering the first and second tabs 380 and 381 in this way hides them from view from the outside and allows the back of the casing to optionally display unobstructed graphics. Optionally, the tabs may be adhered to the front side casing back 313, i.e. outside the card envelope. In either adherence option, casing 310 is sealed completely at its sides and folded at fold 320. This creates an envelope within the casing for receiving a drawer through opening 328. FIG. 10C is a front view of the fully assembled casing 310 showing fold 320, image 372, slit 382, and crossbar section 317. Crossbar section is defined by its two edges provided at 354 and slit 382. Although not shown in FIGS. 10A and 10C, crossbar section may also have an extension of image 372, or portions thereof, printed thereon prior to forming slit 382.

Figure 11A:
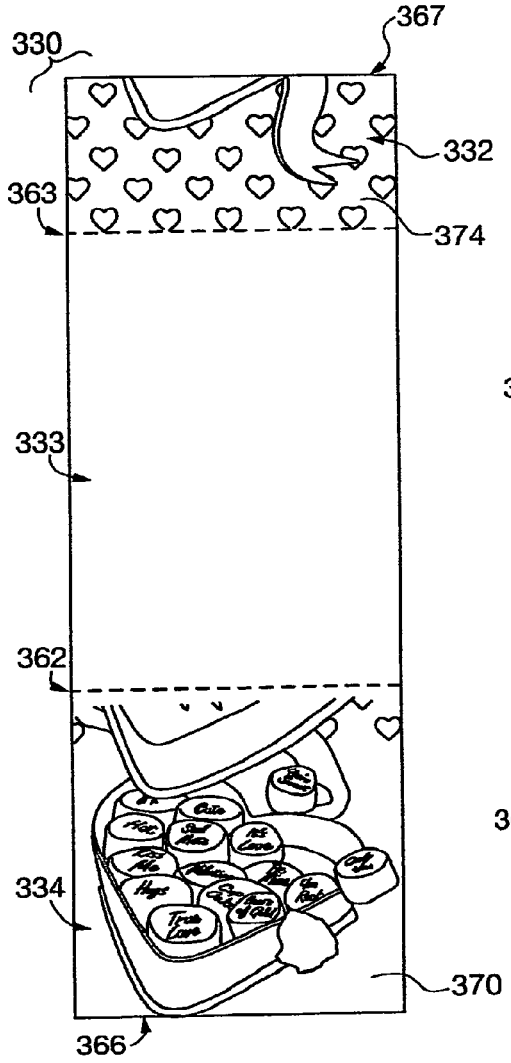
FIGS. 11A and 11B are perspective views of a drawer according to a second embodiment of the invention.
Figure 11B:
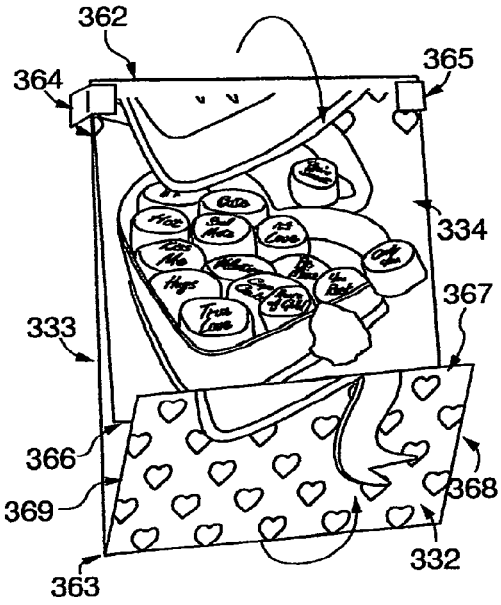

FIGS. 11A and 11B are front and perspective views respectively of an exemplary drawer according to this second embodiment. Drawer 330 may include three sections: drawer front 332, drawer back 333, and hidden section 334. The three drawer sections are delimited by folds 362 and 363 as shown. Edge 366 is provided at the bottom of hidden section 334. FIG. 11B shows a three-dimensional front perspective view of the drawer after folding at folds 362 and 363. In this view, hidden section 334, containing image 370, is folded first at fold 362 and drawer front 332 is folded second at fold 363. Edge 367 of drawer front 332 preferably extends past edge 366 of hidden section 334. In a preferred method of securing the hidden section, drawer front edges 368 and 369 are provided for adherence to mating sections on card back 333. When edge 367 extends beyond edge 366, this provides a pocket into which the hidden section may be tucked at free edge 366 to secure the hidden portion. In another method of securing hidden section 334, the edge 366 itself is adhered to the back side of drawer back 333 and card front may also be adhered to the drawer at portions that mate with edges 368 and 369 on the drawer front. Image 374 is provided on drawer front 332 as a cover image for the card.

Fasteners 364 and 365 may also be optionally included at or near fold 362 wrapping around the drawer to contact front sides of drawer back 333 and hidden section 334. The fasteners may be as simple as a piece of tape but other faster constructions are envisioned as well. For example, appropriately placed slits in the drawer back may release tabs that fold around the hidden section and are secured with an adhesive to the front side of same. Other fasteners include an application of glue inside the drawer fold 362, adhering the back sides of drawer back 333 and hidden section 334 together at or near fold 362 at a predetermined point. Alternatively, any other fasteners, e.g. staples, may be used provided that a seal is formed at the upper portion of the drawer near fold 362. In the example of FIG. 11B fastener 365 is shown as a piece of tape in its fully adhered position. Ultimately, fasteners 364 and 365 perform two functions. First, they create a strong well-defined fold at 362. Second, they provide a closing force to press the drawer back 333 and hidden section 334 together. These two functions partially form a stopping mechanism that limits the extension of the drawer in the card's extended position as described in more detail below.

Figure 12A:
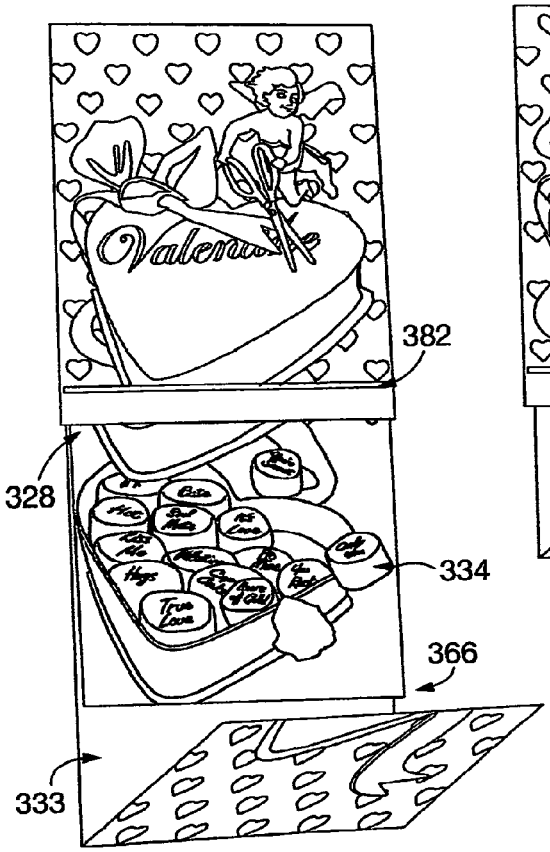
FIGS. 12A-12D are perspective views showing of the stepwise assembly of the card according to a second embodiment of the invention.
Figure 12B:
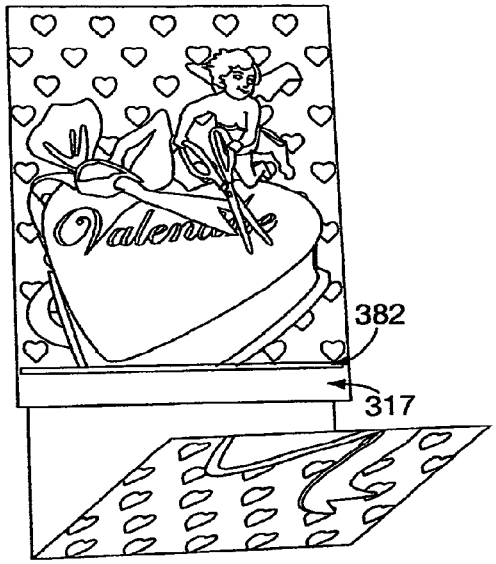
Figure 12C:
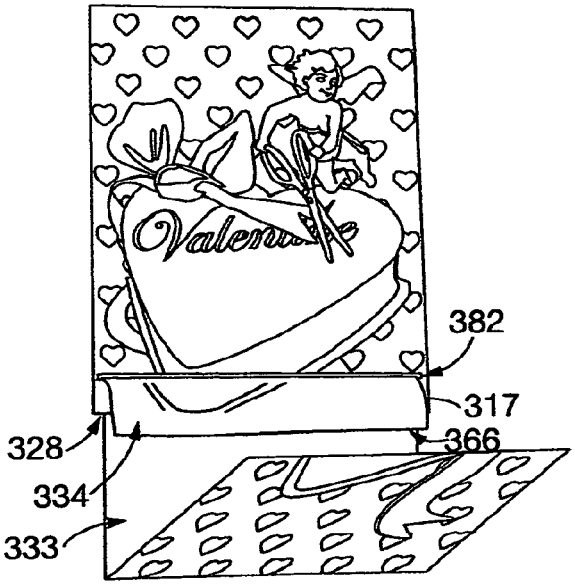
Figure 12D:
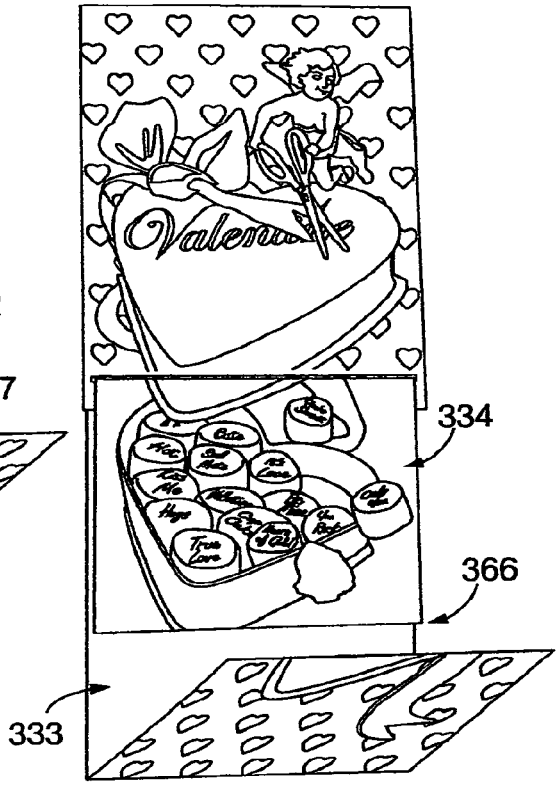

To fully assemble the card, drawer 330 is positioned and laced within casing 310. First, the hidden section and secured drawer back is slid into the casing opening 328 and the hidden section is laced, or slid through slit 382, and pulled such that crossbar section 317 is positioned up against fasteners 364 and 365. FIGS. 12A-12D show the step-wise sequence of this process. As provided in FIG. 12A, secured drawer back 333 and hidden section 334 are first inserted into the casing opening 328 and pushed fully inside the envelope of the casing. Once edge 366 is fully into the casing envelope, and past slit 382, as shown in FIG. 12B, the insertion of the drawer into the casing is complete. Edge 366, hidden in FIG. 12B, is now in line with slit 382 and can be laced back through slit 382 and over crossbar section 317. FIGS. 12C and 12D demonstrate these two successive steps. In FIG. 12C, edge 366 emerges through slit 382 as drawer back 333 and hidden section 334 are pulled back out of the casing envelope. In FIG. 12D, drawer back 333 and hidden section 334 of drawer 330 are fully extended and the slit edge 382 of crossbar 317 butts up against fasteners 364 and 365 (hidden in FIG. 12D) so as to provide a stopping mechanism for drawer extension.

Figure 13:
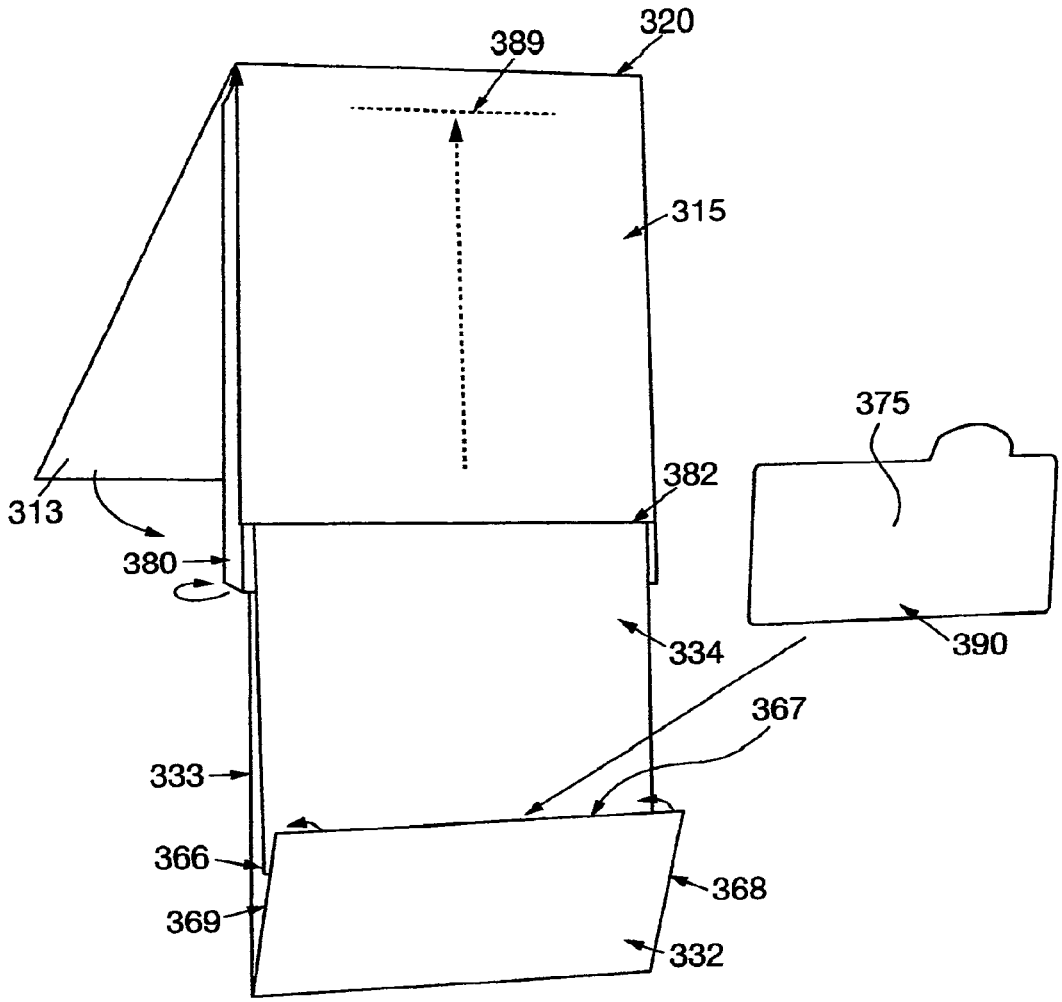
FIG. 13 is a perspective view of a partially assembled card according to a second embodiment of the invention.

FIG. 13 shows a three-dimensional perspective view of the final assembly step of the second embodiment of the invention. In this step, an insertion stop is formed through the adherence of the drawer front 332 to the remaining drawer sections. Hidden section 334 is secured to the drawer by tucking it into the pocket behind drawer front 332 or adhering it directly to other portions of the drawer as described above. An insertion stop is necessary to prevent the drawer from becoming unlaced; that is, from the reversal of the lacing process described above. To create an insertion stop, the drawer front at or near edge 366 has to be secured to the back side of drawer back 333. This can be accomplished simply by adhering edge 366 to drawer back 333. It may also be achieved by adhering the drawer front 332 at or near edges 368 and 369, provided that edge 367 extends beyond edge 366, thereby causing drawer front 332 to partially overlap hidden section 334.

It should be noted that the adherence of the drawer front 332 to drawer back 333 does not have to extend the full length of the edges 368 and 369. In this regard, adherence is only required from fold 363 up to the point at which edge 366 extends downward when the drawer is fully folded at edge 362, provided edge 367 extends beyond edge 366 when completely assembled. This allows an important assembly advantage in that all folding, fastening, and adherence operations can be done before the lacing step. The initial assembly operation of component parts would therefore consist of two high level steps: making a fully assembled casing and a fully assembled drawer. The final assembly steps would involve the lacing of the drawer through the casing and tucking of edge 366 behind edge 367. This permits easy disassembly of the card as well.

The dimensioning of the drawer, the positioning of fasteners thereon and the positioning of the insertion stop are important to the proper function of the card according to the second embodiment of the present invention. In one regard, the card operation cannot be hindered by applying pressure directly to the drawer through the casing while the card is in the fully retracted position. Thus, the length of the hidden section portion of the drawer, as measured from edge 366 to fold 362, is ideally selected to be somewhat shorter than the length of the casing front as measured from edge 354 to fold 320. This is particularly advantageous when the method of drawer sealing is the direct adherence of drawer edge 366 to drawer back 333. If the method of drawer sealing is adhering the drawer front 332 at or near edges 368 and 369, then the length of the seal at or near edges 368 and 369 will govern the final position of fold 362 within the casing envelope. In this case, the fully inserted drawer position is determined by the position of the end of the edge seal which will strike crossbar edge 354 upon full insertion. In either case, card operation is initiated by gently holding the casing at general location 389, beyond the drawer insertion point as shown by the arrow in FIG. 13, such that gripping the card there occurs without pinching the drawer and obstructing its motion within the casing. The drawer is then pulled down until fasteners 364 and 365 strike the crossbar edge at slit 382.

In a second regard, the visual perception and registration of the card images 370, 372, 374 are also determined by the positioning of fasteners thereon and the positioning of the insertion stop. In order for image 370 to properly align with image 372 on casing front 315 the fasteners must be properly positioned at a precise point down the drawer edge from fold 362. This process can be assisted if image 370 is also replicated on crossbar section, at least in part at the fastening edges of the crossbar section. Further, the proper positioning of the direct adherence of edge 366 to drawer to back 333, or alternatively proper regulation of the length of the seal at or near edges 368 and 369, will determine the precise alignment of image 372 on casing front 315 with image 374 on drawer front 332.

In either embodiment of the invention, those of skill in the art will appreciate that, proper dimensioning of the component parts of the cards and the design selection and proper dimensioning of the stopping mechanism all serve to provide better tracking or movement of the drawer within the casing during card operation. The width of the drawer in relation to that of the case is one such criterion. The width of the crossbar section is another, i.e. too thin and it rips upon card extraction; too thick and lacing becomes difficult while card extraction meets with greater frictional resistance.

Finally, as previously mentioned and shown in FIG. 13, an insert 390 may be provided in either embodiment of the invention. The insert is preferably contained within the pocket formed behind the drawer front and consists of a detachable item that can been secured by the pocket so formed. An image 375 may be contained on the insert such that it falls into visual registration with images 370 on hidden portion 334 and/or image 374 on the drawer front 332. If large enough, visual registration with image 372 on casing front 315 is also possible. The insert may be a simple additional inner card where the image is composed of text and/or graphic material, or it may be more functional, such as a small gift, currency envelope, photograph, or other electronic medium or device.

While the invention has been shown and described with reference to specific preferred embodiments, it should be understood by those skilled in the art that various changes in form and detail may be made therein without departing from the spirit and scope of the invention as defined by the following claims.

What is claimed is:

1. A display system comprising:

a casing having a casing front and a casing back, said casing front and casing back affixed to one another and creating an envelope within said casing, said casing having an opening at one end for accessing said envelope;

a drawer having a drawer front, a drawer back and a hidden section, said drawer back affixed to said drawer front and said hidden section such that said drawer front and said hidden section are displayed as a front surface of said drawer, said hidden section of said drawer being capable of insertion into said casing through said opening such that said display system hides said hidden section when said hidden section is fully inserted into said casing;

a stopping mechanism attached to said casing and said drawer, said stopping mechanism preventing said drawer from being removed from said casing through said opening when said drawer is pulled to an extended display position, said hidden section being displayed between said casing front and said drawer front in said extended display position; and wherein said stopping mechanism is a foldable membrane, said membrane affixed at one end to an inner surface of said casing within said envelope and affixed at another end of said drawer, said foldable membrane being folded between said inner surface of said casing and said drawer back in said retracted position, said foldable membrane being extended to a fully extended position when said drawer back is in said extended position.

2. The display system of claim 1 wherein said drawer front is affixed to said drawer back to create a pocket between said drawer front and said drawer back, said pocket having an opening formed at one edge of said drawer front for accessing said pocket.

3. The system of claim 2 further comprising an insert disposed within said pocket.

4. The system of claim 3 wherein said insert is one of: a card, a photograph, an electronic device, a message, a coupon, a toy, currency, a currency holder, a check, a tattoo or a sticker.

5. The system of claim 1 wherein said hidden section is an integrated part of said drawer back; said drawer front and said hidden section both have images, said images being printed on opposite sides of said drawer.

6. The system of claim 1 wherein said foldable membrane is one of: a string, a piece of paper having at least 1 fold thereon, flexible plastic or a woven membrane.

7. A display system comprising:

a casing having a casing front and a casing back, said casing front and casing back affixed to one another and creating an envelope within said casing, said casing having an opening at one end for accessing said envelope;

a drawer having a drawer front, a drawer back and a hidden section, said drawer back affixed to said drawer front and said hidden section such that said drawer front and said hidden section are displayed as a front surface of said drawer, said hidden section of said drawer being capable of insertion into said casing through said opening such that said display system hides said hidden section when said hidden section is fully inserted into said casing;

a stopping mechanism attached to said casing and said drawer, said stopping mechanism preventing said drawer from being removed from said casing through said opening when said drawer is pulled to an extended display position, said hidden section being displayed between said casing front and said drawer front in said extended display position; and wherein said casing includes a slit on said casing front so as to form a crossbar section across said opening at said slit, said hidden section inserted through said slit such that said crossbar section is disposed between said hidden section and said drawer back, said hidden section including fasteners near a fold dividing said drawer back and said hidden section, said fasteners being in contact with said crossbar section at said slit when said display is extended to a fully extended position such that said fasteners and said crossbar section create said stopping mechanism.

8. The display system of claim 7 wherein said drawer front is affixed to said drawer back to create a pocket between said drawer front and said drawer back, said pocket having an opening formed at one edge of said drawer front for accessing said pocket.

9. The system of claim 8 further comprising an insert disposed within said pocket.

10. The system of claim 9 wherein said insert is one of: a card, a photograph, an electronic device, a message, a coupon, a toy, currency, a currency holder, a check, a tattoo or a sticker.

11. The system of claim 7 wherein said hidden section is an integrated part of said drawer back; said drawer front and said hidden section both have images, said images being printed on opposite sides of said drawer.

12. A greeting card comprising:

a casing having a casing front with an image and a casing back, said casing front and casing back affixed to one another with tabs on the sides of said casing and creating an envelope within said casing once said tabs are affixed, said casing having an opening at one end for accessing said envelope, said casing including a slit on said casing front so as to form a crossbar section across said opening at said slit; and a drawer having a drawer front, a drawer back having an image and a hidden section having an image, said drawer back affixed to said drawer front and said hidden section such that said drawer front and said hidden section are displayed substantially coplanar as a front surface of said drawer, said hidden section of said drawer being capable of insertion into said casing through said opening such that said casing hides said hidden section and image within said envelope and said card displays said casing front image and said drawer front image so as to appear as two parts of a single image when said hidden section is fully inserted into said casing, said hidden section inserted through said slit such that said crossbar section is disposed between said hidden section and said drawer back, said hidden section including fasteners near a fold dividing said drawer back and said hidden section, said fasteners being in contact with said crossbar section at said slit when said card is extended to a fully extended position so as to stop said card extension at said fully extended position, said hidden section image being revealed when said card is in an extended display position, and said image on said hidden section, said drawer front image and said casing front image appearing as three parts of a single image when said card is in said fully extended display position.

13. The system of claim 12 wherein said drawer front is affixed to said drawer back to create a pocket between said drawer front and said drawer back, said pocket having an opening formed at one edge of said drawer front for accessing said pocket.

14. The system of claim 13 further comprising an insert disposed within said pocket.

15. The system of claim 14 wherein said insert is one of: a card, a photograph, an electronic device, a message, a coupon, a toy, currency, a currency holder, a check, a tattoo or a sticker.

16. A method of assembling a display system comprising:

inserting a drawer into a casing having an opening and a crossbar, said crossbar being formed by a slit in said casing;

sealing a hidden section of said drawer near a fold at the top of said drawer with fasteners;

lacing said hidden section of said drawer through said slit in said casing; and securing said hidden section to said drawer at a drawer bottom so as to encircle said crossbar and provide a stopping mechanism at said crossbar and said fasteners when said drawer is pulled out of said casing.

17. The method of claim 16 further comprising sealing a drawer front of said drawer near a fold at the bottom of said drawer on two sides so as to form a pocket behind said drawer front.

18. The method of claim 17 further comprising inserting an insert into said pocket.

19. The method of claim 16 wherein said step of securing includes tucking said hidden section behind said drawer front.

20. The method of claim 16 wherein said step of securing includes adhering said hidden section to said drawer.

* * * * *